US006555490B1

(12) United States Patent
Wildbore et al.

(10) Patent No.: US 6,555,490 B1
(45) Date of Patent: Apr. 29, 2003

(54) LINING MATERIAL

(75) Inventors: Kirsty Marlene Wildbore, Nuneaton (GB); Susan Gwynneth Johnson, Botcheston (GB); Roger Alan Chapman, Kenilworth (GB)

(73) Assignee: Texon UK Limited, Leicester (GB)

( * ) Notice: Subject to any disclaimer, the term of this patent is extended or adjusted under 35 U.S.C. 154(b) by 0 days.

(21) Appl. No.: 09/331,497

(22) PCT Filed: Dec. 11, 1997

(86) PCT No.: PCT/GB97/03421

§ 371 (c)(1),
(2), (4) Date: Jul. 22, 1999

(87) PCT Pub. No.: WO98/28476

PCT Pub. Date: Jul. 2, 1998

(30) Foreign Application Priority Data

Dec. 21, 1996 (GB) ..... 9626636

(51) Int. Cl.[7] ..... D04H 1/46

(52) U.S. Cl. ..... 442/402; 36/43; 36/71; 428/196; 428/198; 428/373; 442/76; 442/79; 442/85; 442/96; 442/118; 442/123; 442/320; 442/323; 442/361; 442/362; 442/363; 442/364; 442/365; 442/388; 442/389; 442/403

(58) Field of Search ..... 36/43, 71; 428/196, 428/198, 373; 442/76, 79, 85, 96, 118, 123, 320, 323, 361, 362, 363, 364, 365, 388, 389, 402, 403

(56) References Cited

U.S. PATENT DOCUMENTS

| | | | | | |
|---|---|---|---|---|---|
| 4,382,987 | A | * | 5/1983 | Smart | 428/212 |
| 4,414,961 | A | * | 11/1983 | Luebke | 126/432 |
| 4,981,749 | A | * | 1/1991 | Kubo et al. | 428/219 |
| 5,043,209 | A | * | 8/1991 | Boisse et al. | 428/233 |
| 5,607,745 | A | | 3/1997 | Ogden | |
| 5,800,897 | A | * | 9/1998 | Sharma et al. | 428/74 |
| 6,100,207 | A | * | 8/2000 | Dean et al. | 442/350 |
| 6,171,446 | B1 | * | 1/2001 | Diaz-Kotti | 162/358.2 |

FOREIGN PATENT DOCUMENTS

| | | | | |
|---|---|---|---|---|
| EP | 0 388 072 A2 | | 3/1990 | |
| EP | 0 414 395 A1 | | 8/1990 | |
| EP | 0 814 188 A1 | | 12/1997 | |
| GB | 1421694 | * | 1/1976 | D04B/21/14 |
| GB | 2 314 097 | | 12/1997 | |
| WO | WO 90/12130 | * | 10/1990 | D01D/5/253 |

* cited by examiner

*Primary Examiner*—Terrel Morris
*Assistant Examiner*—Arti Singh
(74) *Attorney, Agent, or Firm*—Fish & Richardson P.C.

(57) ABSTRACT

The invention features a lining material for footwear. The material includes a non-woven felt including up to 80% by weight of grooved or multi-lobed cross section transport fibers and the remainder of thermally bondable fibers arranged to secure the transport fibers against abrasion and excessive mechanical stretch presented during incorporation of the lining material into a product during that product's manufacture.

8 Claims, No Drawings

LINING MATERIAL

The present invention relates to a lining material and more particularly, but not exclusively, to a lining material for footwear.

A large number of products include a lining material for a variety of reasons. For example, a lining material is used within footwear to improve wearer comfort, abrasion resistance and for presentational reasons. Alternatively, linings are applied to clothing and other products in order to achieve a similar wear abrasion, moisture control and simply to facilitate more efficient product construction or operation.

Of particular concern with some lining materials is the ability to wick away moisture from damp areas and this is a particular requirement in footwear linings. Absorbent fibres can be used in linings to facilitate this moisture wick ability. However, the abrasion resistance of linings using such fibres has been limited. More recently, improved wicking synthetic fibres have been developed which have a grooved cross-section to promote capillary transport of moisture along the fibre and thus disperse moisture more rapidly about the lining material made from such fibres.

One type of lining material is a non-woven felt comprising appropriately needle entangled fibres to form a felt of suitable weight and gauge for the product in which the lining is to be applied. One such lining is marketed by British United Shoe Machinery Limited, Leicester, England under the trademark Aquiline. In order to incorporate such grooved cross section fibres for their wicking efficiency within a non-woven fabric, the grooved cross-section fibres it will generally be needle entangled as with previous felts. However, it has been found with typically available grooved cross section fibres, such as fibre 4DG supplied by the Eastman Chemical Company of Tennessee, USA or multi-lobed cross-section such as fibres-sold as Dacron, in simple fibre entangled felts have had too high an abrasion rate for acceptable performance in such products as footwear or clothing. Furthermore, the felts have had too high a stretch rate during product manufacture.

It will be appreciated that generally non-woven felts depend upon fibre entanglement and fibre friction slip resistance to ensure consolidation. Thus, with grooved or multi-lobed cross section fibres it may be that there is less surface contact between fibres to provide such entanglement and friction resistance i.e. only the tops of the grooves or channels are available as compared to a generally round cross section fibre. The valleys of the channels are not available even though they do provide the facility of capillary wicking as indicated above and are available for application of a suitable coating for hydrophobic or hydrophobic attraction of moisture or other desired performance criteria e.g. electrical/thermal conductivity, ph resistance etc. With regard to stretching, it will be appreciated that the felt may become distorted after a manufacturing stage due to fibre slippage passed one another and there will be no 'bounce back' to its original shape.

It is an object of the present invention to provide a lining material based upon non-woven felts that incorporates grooved or multi-lobed cross sectioned fibres for improved wicking whilst maintaining acceptable abrasion levels and properties adequate for shoe manufacture and for durability in use.

In accordance with the present invention there is provided a lining material for footwear, the material comprising a non-woven felt made of up to 80% by weight of grooved or multi-lobed cross section transport fibres and the remainder thermally bondable fibres arranged to secure said transport fibres against abrasion and excessive mechanical stretch present during incorporation of such lining material into a product during that product's manufacture.

Preferably the transport fibres are 4DG fibre supplied by the Eastman Chemical Company of Tennessee, USA or Dacron.

Preferably the thermally bondable fibres may be polypropylene fibres, bicomponent fibres or low melting polyester fibres, all of the appropriate decitex.

In replacement of a certain proportion of the transport fibres, anti-bacterial fibres or other special performance fibres may be included in the non woven felt.

Preferably, the lining material has a density in the range 150–160 kg per cubic meter and preferably about 156 kg per cubic meter. The material preferably has a weight of 250 gsm and a gauge of 1.6 mm but may have a weight in the range 100–400 gsm.

Preferably the thermally bondable fibres have a decitex in the range 1.7–5.0 decitex but in any event sufficient to allow upon heating the transport fibres to be resiliently bonded or embedded within the thermally bondable fibres without the thermally bondable fibres melting completely. The preferred decitex of the thermally bondable fibres is 2.5 whilst the transport fibres may have a decitex in the range 2.5 to 4.0 decitex but most advantageously, with 4DG fibre, of 3.3 decitex.

The preferred composition of the lining material is 70% 4DG fibre, 3.3 decitex blended with 30% polypropylene fibre, 2.5 decitex with a weight after thermal activation of 250 gsm and a gauge of 1.6 mm.

An embodiment of the present invention will now be described by way of example only.

The lining material in accordance with the present invention is produced by thermally bonding a needle felt composed of a blend of thermally bondable fibres for example in a preferred embodiment, polypropylene, with grooved or multi-lobed cross section fibres designed to wick moisture away from a point or area of contact with the material.

It is the special nature of grooved cross section fibres which give the lining material its moisture transporting properties. Tiny grooves within the fibre act as capillaries actively channelling the liquid moisture away from a source in contact with the lining material and thus themselves. In the case of a lining material used in footwear this may be the actual surface of the foot or damp hose. In a footwear vamp lining which extends to the top line of a shoe or in an exposed tongue, the liquid will be actively channelled away from the toes and the dorsal surface of the foot to the outside environment where it may be evaporated away and at least is not detrimental to the wearer's comfort.

The lining material includes thermally bonding fibres to allow the lining material to be stabilised and so resistant to stretching during product manufacture and resistance to abrasion during wear. It will be understood, particularly with regard to manufacture of footwear, that products including linings can be formed about forming elements such as a shoe last. Generally, during such forming process of the product fabrication, the lining will be stretched in order to secure the various components together. It is important that the lining does not become distorted and so must not tear during manufacturing.

The range of thermally bonding fibres which can be used is quite extensive as the requirement is simply to provide upon heating a suitably tacky surface in which the grooved cross section fibres can become bonded or embedded such that upon cooling the grooved cross section fibres are secured within the lining material. As indicated above it is submitted one of the reasons that grooved cross section fibres may be susceptible to abrasion and stretch distortion is reduced friction contact between fibres in the felt, the bond/embedding of the grooved cross-section fibres in the thermally bonding fibres thus supplements and enforces cross sectional fibre location within the lining material. Alternative thermally bonding fibres to polypropylene are bicomponent or low melting polyesters.

It will be appreciated that the bulk of the lining material is made up of grooved cross section fibres which can be termed moisture transport fibres within the lining structure. However, the moisture wicking facility of the lining material is obviously only one attribute necessary of such a lining material and therefore the requirements of other attributes of the lining material must be considered. Consequently the proportion of transport fibres within the lining material is chosen in balance with these other requirements of the lining material and the proportion of thermally bondable fibres chosen in order to anchor and secure such lining material against stretching and abrasion during work and manufacture of the product. The preferred transport fibre or grooved cross section fibre is 4DG (3.3 decitex) produced by The Eastman Chemical Company of Tennessee, USA. However, alternative fibres may be used such as Dacron 702W.

It will be appreciated that grooved cross section fibres are generally more expensive than staple fibres and thus, provided the inherent reduction in moisture wicking capacity and possible inferior abrasion resistance is acceptable, a proportion of the transport fibres may be replaced by ordinary round section polyester or nylon. Similarly, other speciality fibres may be included to enhance specific performance of the lining material. For example, anti-bacterial or anti-static fibres may be added to the lining material during the blending stage in order to enhance lining performance. Such speciality fibres will be added in replacement of the transport fibre as it will be appreciated there is a minimum proportion of thermally bondable fibres in the lining material to ensure adequate stabilisation through bonding with other fibres. This level as indicated above is generally 20% by weight of the non woven felt and thus the lining material. However, if either the transport or bonding fibres are coated with an adhesive this blend level may be reduced.

An example of a typical lining material in accordance with the present invention comprises a blend of, by weight, 30% polypropylene fibre (2.5 decitex) and 70% 4DG fibre (3.3 decitex). The blend of fibres are carded and needled to produce a needle felt of approximately 220 gsm and a gauge of 1.8 mm. This needle felt is heat treated with hot air dependant upon the thermally bondable fibres available. This hot air may be blown by fans etc. For the polypropylene fibres used in this example a temperature of 165° C. was used. However, it will be appreciated with some low temperature polyesters a temperature in the order of 130° C. may be acceptable. After heat treatment of the needle felt using hot air as described previously, the lining material is passed through a mangle type arrangement with a slight nip i.e. slightly less gauge than that presented to it. The rollers of the mangle are relatively cool and typically will be at room temperature. After the lining material has passed through the mangle the finished lining material will generally have a weight of approximately 250 gsm and a gauge of 1.6 mm. Such finished lining material is suitable for footwear and similar applications.

In choice of the fibre decitex, both for the thermally bondable fibres and for the transport fibres it is important to remember that too fine a decitex is susceptible to abrasion due to fibre weakness, whilst too coarse a fibre is susceptible to abrasion due to the fibre being too strong and causing the formation of pills which speed up abrasion. Furthermore, most grooved cross section fibres e.g. 4DG is only available in certain decitex sizes and so generally the appropriate decitex for the lining material is dependant upon the fibre used. Typically, the transport fibres, i.e. grooved cross section fibres will be in the range of 2–4 decitex. The thermo bondable fibres, as indicated above, should not completely melt within the needle felt and so generally a decitex of sufficient gauge is used to ensure that a surface portion of the fibre becomes tacky to allow embedding or bonding of the transport fibre to it. Typically, bondable fibres in the range 1.7–5 decitex are acceptable.

A major determining factor with regard to the lining material is the actual degree of concentration of the needle felt through the entanglement procedure and heat treatment. This degree of concentration is determined generally by the density which in turn is a product of the particular fibres used i.e. in terms of their density. However, with the 30% polypropylene/70% 4DG fibre, the example given above, it has been found that a lining material density in the range 150–160 kg per cubic meter and preferably 156 kg per cubic meter is acceptable. Thus a preferred finished lining material as indicated above may have a weight of 250 g per square meter and 1.6 mm gauge. However, the weight of the material may vary between 1000 gsm and 400 gsm with appropriate alteration in the gauge of the material. Lining materials below 100 gsm are generally too fragile for lining whilst materials in excess of 400 gsm generally may be too stiff for most lining materials.

It will be appreciated that the grooved cross section fibre may be used in addition to a moisture wicking agent as a recepticle for reagents. Furthermore, within footwear and clothing the lining material including the grooved cross section, transport fibres could be adapted to release perfume or deodorant by incorporating reagents, activated carbon or microbubbles of such perfumes within the grooves or channels of the transport fibres. Such reagents or microbubbles of perfume etc. would be released upon contact with moisture. Such incorporating of reagents etc. within the grooved cross section fibres may occur either prior to blending or during blending or after the lining material has been manufactured. It will be appreciated that if such adaptation of the grooved cross section of fibres occurs prior to blending or lining material manufacture it will be possible to treat different weight proportions of the grooved cross section fibres in the lining material with different treatments i.e. some perfumed, some anti-static whilst others have a deodorant in order to provide respectively these facilities within the lining material. The ability to provide such value added features to lining materials will be of significant advantage with regard to consumer goods such as footwear, clothing and haberdashery.

Finally, the grooves of the transport fibre may be used to incorporate germicides, anti-bacterial agents and even pesticides or insect repellent agents used to deter moths or mosquitos e.g. mothball type deterrents in clothing.

The use of grooved cross section fibres in lining materials in accordance with the present invention is particularly advantageous in that due to the active capillary action drawing the moisture/liquid away it will be understood that such movement can be substantially against gravity, within limits, and therefore upwards. This is of course a great benefit with regard to footwear linings where the lining will generally be in a vertical aspect. Furthermore, due to the capillary nature of retention i.e. physical rather than chemical absorption, the capacity to retain moisture within the fibre may be increased irrespective of orientation and such liquid can be readily evaporated as compared to chemical absorption/retention within some hydrophilic fibres.

As an alternative to hot air activation of the fibre entangled felt it may be possible to use hot rollers or flats or simply an oven at an appropriate temperature.

What is claimed is:

1. A lining material for footwear, the material comprising a non-woven felt including up to 80% by weight of grooved or multi-lobed cross section transport fibres and the remainder thermally bondable fibres arranged to secure said transport fibres against abrasion and excessive mechanical stretch presented during incorporation of such lining material into a product during that product's manufacture.

2. A lining material as claimed in claim 1 wherein the transport fibres are 4DG fibres (grooved cross-section polyester fibres designed to transport liquids by wicking and capillary action) supplied by the Eastman Chemical Company or Dacron Fibres.

3. A lining material as claimed in claim 1, wherein the thermally bondable fibres comprise a range of decitex sufficient to allow upon heating the transport fibres to be resiliently bonded or embedded in the thermally bondable fibres without the thermally bondable fibres melting completely.

4. A lining material as claimed in claim 1 wherein the lining material includes, in substitution for a proportion of the transport fibres, a proportion of antibacterial fibres or other special performance fibres in order to provide such anti-bacterial or special performance lining material.

5. A lining material as claimed in any preceding claim in which the lining material has a density in the range 150–160 kg per cubic meter or a weight in the range of 100–400 gsm.

6. A lining material as claimed in claim 1 wherein the thermally bondable fibres have decitex in the range 1.7–5.0 and the transport fibres have a decitex in the range of 2.5–4.0.

7. A lining material having a composition, by weight percentage, of 70% 3.3 decitex 4DG fibres (grooved cross-section polyester fibres designed to transport liquids by wicking and capillary action) blended with 30% 2.5 decitex polypropylene fibres to give a weight of 250 grammes per square meter (gsm) with a gauge of 1.6 mm.

8. A lining material as claimed in claim 1, wherein the thermally bondable fibre is selected from the group consisting of polypropylene fibres, bicomponent polyester fibres, low melting polyester fibres and combinations thereof.

* * * * *

UNITED STATES PATENT AND TRADEMARK OFFICE

CERTIFICATE OF CORRECTION

PATENT NO. : 6,555,490 B1 
DATED : April 29, 2003
INVENTOR(S) : Susan Gwynneth Johnson, Kirsty Marlene Wildebore and Roger Alan Chapman It is certified that error appears in the above-identified patent and that said Letters Patent is hereby corrected as shown below:

Title page,
Item [57], ABSTRACT,
Line 4, replace “fibers” with -- fibres --.

Column 6,
Line 6, replace “any preceding claim” with -- claim 1 --.
Line 8, replace “meter” with -- metre --.

Signed and Sealed this

Sixteenth Day of March, 2004

JON W. DUDAS
*Acting Director of the United States Patent and Trademark Office*